United States Patent [19]

Takagi

[11] 4,393,286

[45] Jul. 12, 1983

[54] VACUUM CIRCUIT BREAKERS

[75] Inventor: Kunihiko Takagi, Tama, Japan

[73] Assignee: Tokyo Shibaura Denki Kabushiki Kaisha, Kanagawa, Japan

[21] Appl. No.: 66,772

[22] Filed: Aug. 15, 1979

[30] Foreign Application Priority Data

Aug. 24, 1978 [JP] Japan ..... 53-102273
Aug. 24, 1978 [JP] Japan ..... 53-102274

[51] Int. Cl.[3] ..... H01H 33/66

[52] U.S. Cl. ..... 200/144 B; 174/209; 174/84 R

[58] Field of Search ..... 200/144 B; 174/209, 174/211, DIG. 8, 84

[56] References Cited

U.S. PATENT DOCUMENTS 2,706,742 4/1955 Ehlers ..... 174/52 PE
2,870,298 1/1959 Schwager ..... 200/144 B
3,297,819 1/1967 Wetmore ..... 174/84 R
3,626,125 12/1971 Tonegawa ..... 200/144 B
3,812,314 5/1974 Nonken ..... 200/144 B
3,955,167 5/1976 Kumbera ..... 200/144 B
4,124,790 11/1978 Kumbera et al. ..... 200/144 B

FOREIGN PATENT DOCUMENTS 1126053 9/1968 United Kingdom ..... 200/144 B

*Primary Examiner*—Robert S. Macon
*Attorney, Agent, or Firm*—Stevens, Davis, Miller & Mosher

[57] ABSTRACT

A vacuum circuit breaker having a vacuum bulb comprises a coating of a greasy compound of a water repellent material provided on the outer surface of the bulb, and an insulating tube of a water repellent and heat shrinkable material provided on the coating of the greasy compound.

3 Claims, 4 Drawing Figures

VACUUM CIRCUIT BREAKERS

BACKGROUND OF THE INVENTION

The present invention relates to a vacuum circuit breaker and more particularly to a vacuum bulb which is suitable for use in a dirty and damp atmosphere.

A conventional vacuum circuit breaker is schematically illustrated in FIG. 1. The vacuum circuit breaker comprises an insulating vessel 1, a stationary contact 2 and a movable contact 3. The insulating vessel 1 provides not only insulation between the contacts 2 and 3, but also hermetic seal to maintain a high degree of vacuum, and is required to be compact and reliable. Therefore, the vessel 1 is usually made of glass or ceramics and formed in a cylindrical shape. The outer surface of the cylindrical vessel 1 has a relatively small creeping distance, so that when the vessel 1 is wet and contaminated leak discharge, which is a creeping discharge initiated by a leak current, along the surface is easy to occur, and, moreover, flashover may occur upon opening of the vacuum circuit breaker to render the vacuum switch incapable of interruption.

To improve the insulating strength of the outer surface of the vacuum bulb, the cylindrical vessel 1 is covered by an insulating outer cylinder 4 made of epoxy resin or the like and having a corrugated outer surface having alternate furrows and ridges, so that the creeping distance is increased. The epoxy resin may be directly coated or molded on the insulating vessel 1. In this case, the manufacture of the vacuum bulb is relatively simple, but the difference in coefficient of thermal expansion between the insulating vessel 1 and the insulating outer cylinder 4 causes internal stresses, which may cause breakage of the vacuum bulb or separation at the interface between the insulating vessel 1 and the insulating outer cylinder 4, leading to corona discharge. Alternatively, an intermediate layer 5 of soft resin may first be provided on the insulating vessel 1 and the resinous intermediate layer may be provided on the intermediate layer 5. The interposition of the layer 5 relieves the internal stresses, so that the breakage and the separation are avoided. However, because no inorganic filler is mixed in the soft resin, the intermediate layer 5 does not have sufficient mechanical strength and is liable to break due to impact which takes place during the closure and opening of the vacuum switch.

Moreover, use of resinous moldings as the insulating outer cylinder increases weight and size of the vacuum bulb, and cost of the mold and the resinous material.

SUMMARY OF THE INVENTION

An object of the present invention is to provide a vacuum circuit breaker provided with a vacuum bulb which is compact, inexpensive and reliable, and withstands dirty and damp atmosphere.

Another object of the invention is to provide a vacuum circuit breaker including a vacuum bulb which can be designed to have an optimum creeping distance depending on the particular condition in which the vacuum circuit breaker is used.

According to the invention, there is provided a vacuum circuit breaker having a vacuum bulb including an insulating member for containing a movable contact and a stationary contact, characterized by comprising: a coating of a greasy compound of a water repellent material provided on the outer surface of the bulb, and an insulating tube of a water repellent and heat shrinkable material provided on the coating of the greasy compound.

DESCRIPTION OF THE PREFERRED EMBODIMENTS

Figure 1:
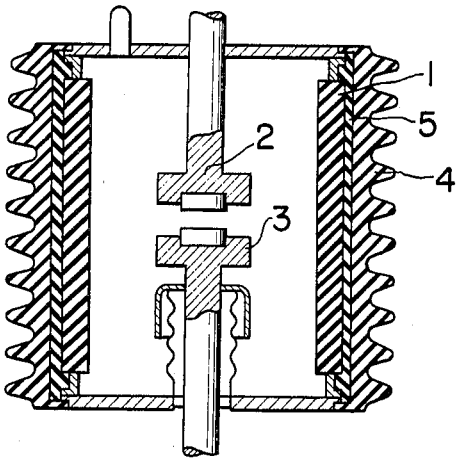
FIG. 1 PRIOR ART
FIG. 1 is a sectional view showing a conventional vacuum circuit breaker.
Figure 2:
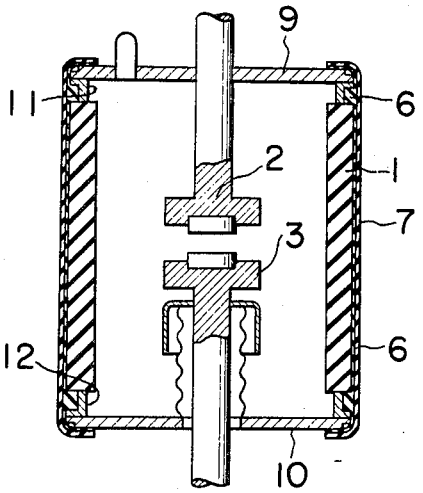
FIG. 2 is a sectional view of one embodiment of a vacuum circuit breaker according to the invention.

As shown in FIG. 2, a vacuum circuit breaker incorporating an improved vacuum bulb comprises a cylindrical insulating vessel 1, constituting a cylindrical wall of the vacuum bulb, and a pair of annular conductive members 9 and 10 having their edges connected to the ends of the cylindrical insulating vessel 1 by fixing members 11 and 12. The annular conductive members respectively support a stationary contact 2 and a movable contact 3. A greasy compound 6 having a water repellent property is applied or coated on the insulating vessel 1, as well as the outer edges portions of the annular conductive members 9 and 10. The greasy compound 6 may, for example, comprise a silicone compound. An insulating tube 7 is made of a water repellent and heat shrinkable material such as a fluorine containing resin.

Because the insulating tube 7 is water repellent, any water on the surface of the tube 7 is disintegrated into droplets which are separated from each other. Thus, conductive film due to contamination is not formed. Therefore, insulating strength of the vacuum bulb is not lowered even if it is used in a dirty and damp atmosphere.

The insulating tube 7, which has a water repellent property as described above, may have pinholes. Also, a gap may be formed between the insulating tube 7 and the insulating vessel 1. In either case, entry of water results in dew condensation, which causes deterioration of the insulation strength. Particularly, the insulating vessel 1 is made of glass or ceramics which is easy to be wet, which may cause corona discharge. However, according to the invention, there is provided the coating of the water repellent greasy compound 6, which is compressed between the heat shrinkable insulating tube 7 and the insulating vessel 1. This arrangement eliminates the problem of the deterioration of insulation strength. More particularly, the insulation at the interface is maintained by the water repellent greasy compound 6 and the insulation on the outer surface is maintained by the insulating tube 7, so that leak discharge is entirely prevented.

Figure 3:
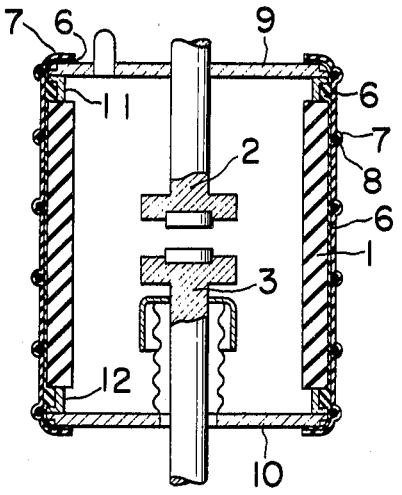
FIG. 3 is a sectional view showing another embodiment of the invention.

FIG. 3 shows another embodiment of the invention. In this embodiment, water repellent greasy compound 6 is coated on the insulating vessel 1, and insulating rings 8 made of rubber or plastics are provided on the coating of the greasy compound 6. A water repellent heat shrinkable insulating tube 7 is provided to cover the coating of the greasy compound 6 and the insulating rings 8, and, upon application of heat, the insulating tube 6 shrinks, so that the insulating rings 8 are pressed and secured to the insulating vessel 1. In this way, insulating rings are provided between the coating of the greasy compound 6 and the insulating tube 7.

The number of the insulating rings 8 can be determined to result in a suitable creeping distance depending on the particular condition in which the vacuum circuit breaker is intended to be used.

Figure 4:
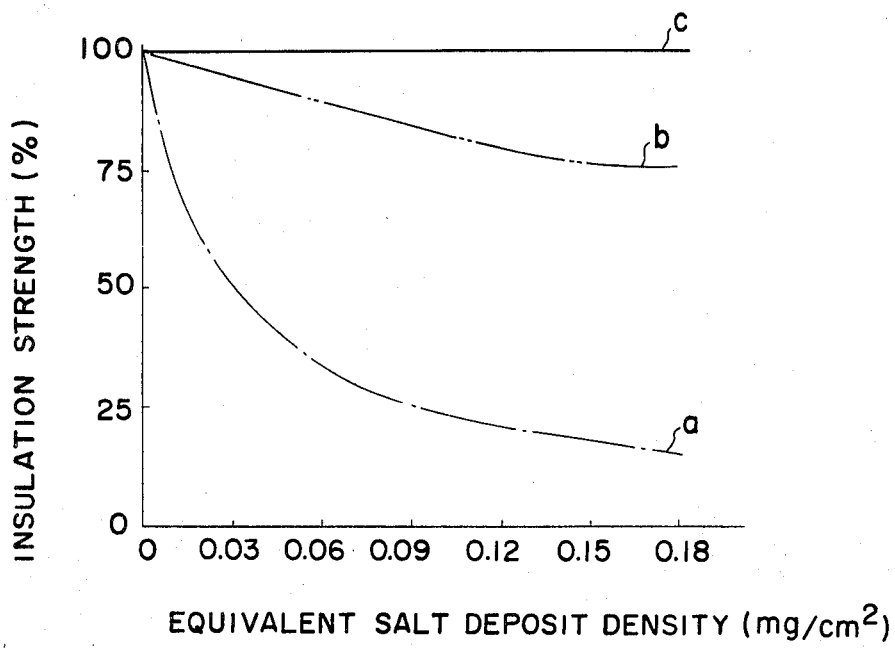
FIG. 4 is a graph showing the characteristics of a conventional bulb and the bulbs according to the invention.

FIG. 4 shows the insulation strength in relation to the degree of contamination, in terms of equivalent salt deposit density. The curve a represents characteristics of a conventional vacuum bulb. As will be observed, the insulation strength is substantially deteriorated as the degree of contamination is increased. The curves b and c represent characteristics of the vacuum tubes according to the invention. Deterioration of the insulation strength is much less. Thus, the problem of deterioration of insulation strength due to contamination is decreased, and reliability of the vacuum bulb is improved. Moreover, the size and the cost of the vacuum bulb is reduced.

Furthermore, by increasing the number of the insulating rings, the insulation strength can be further improved.

What is claimed is:

1. In a vacuum circuit breaker having a vacuum bulb including an insulating member for containing a movable contact and a stationary contact, the improvement which comprises:

a coating of a greasy compound of a water repellent material provided on the outer surface of said insulating member;

an insulating tube of a water repellent and heat shrinkable material provided on said coating of the greasy compound; and insulating rings between said coating of the greasy compound and said insulating tube.

2. A vacuum circuit breaker as claimed in claim 1, further comprising a conductive portion, wherein said coating of the greasy compound is also provided on the outer surface of said conductive portion.

3. A vacuum circuit breaker as claimed in claim 1, wherein said vacuum bulb comprises a cylindrical insulating member and a pair of annular conductive members having their respective edge portions connected to both ends of said cylindrical insulating member, and said coating of the greasy compound is provided to cover said edge portions of said annular conductive members.

* * * * *